US006273677B1

(12) United States Patent
Wang et al.

(10) Patent No.: US 6,273,677 B1
(45) Date of Patent: Aug. 14, 2001

(54) CENTRIFUGAL PUMP WITH INFLOW GUIDE DEVICE

(75) Inventors: Baogang Wang, Frankenthal; Juergen Schill, Weisenheim; Dieter Hellmann, Kaiserlautern, all of (DE)

(73) Assignee: KSB Aktiengesellschaft, Frankenthal (DE)

( * ) Notice: Subject to any disclaimer, the term of this patent is extended or adjusted under 35 U.S.C. 154(b) by 0 days.

(21) Appl. No.: 09/424,786

(22) PCT Filed: May 18, 1998

(86) PCT No.: PCT/EP98/02908

§ 371 Date: Nov. 29, 1999

§ 102(e) Date: Nov. 29, 1999

(87) PCT Pub. No.: WO98/54471

PCT Pub. Date: Dec. 3, 1998

(30) Foreign Application Priority Data

May 28, 1997 (DE) ..... 197 22 353

(51) Int. Cl.[7] ..... F04D 29/44

(52) U.S. Cl. ..... 415/191; 415/206; 415/208.2

(58) Field of Search ..... 415/58.2, 58.3, 415/183, 184, 185, 187, 191, 204, 205, 206, 208.2

(56) References Cited

U.S. PATENT DOCUMENTS

| | | | | |
|---|---|---|---|---|
| 2,083,185 | * | 6/1937 | Anderson | 415/58.3 |
| 2,834,536 | * | 5/1958 | McDonald | 415/191 |
| 4,854,818 | * | 8/1989 | Meng | 415/58.4 |
| 4,884,942 | * | 12/1989 | Pennink | 415/104 |
| 5,746,575 | * | 5/1998 | Westphal et al. | 415/206 |

* cited by examiner

*Primary Examiner*—Edward K. Look
*Assistant Examiner*—Ninh Nguyen
(74) *Attorney, Agent, or Firm*—Crowell & Moring, L.L.P.

(57) ABSTRACT

A centrifugal pump having an axial inlet and an inflow guide device mounted upstream of the impeller, which guide device is composed of several fixed guide vanes, which on the side facing the impeller each have an edge pointing in or opposite to the direction of rotation of the impeller. The edge pointing in or opposite to the direction of rotation may take the form of a swirl blade (8) which is formed on the guide vane (6) and located in the vicinity of the wall of the inlet (2), and which has a shorter radial length than the guide vane (6). This increases the efficiency of the pump and achieves an effect which increases the breadth of applicability of the pump.

5 Claims, 1 Drawing Sheet

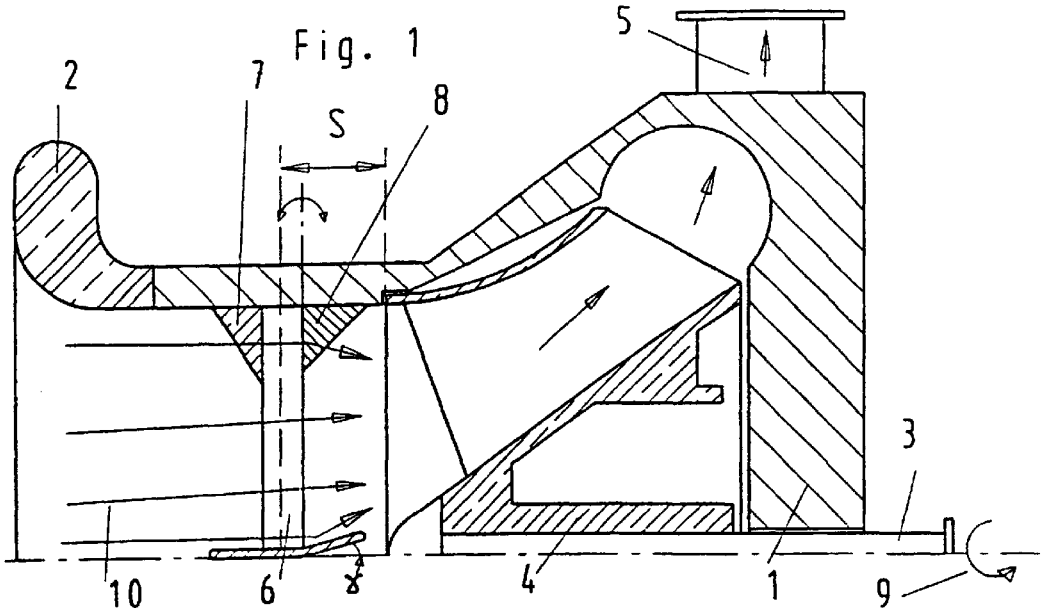
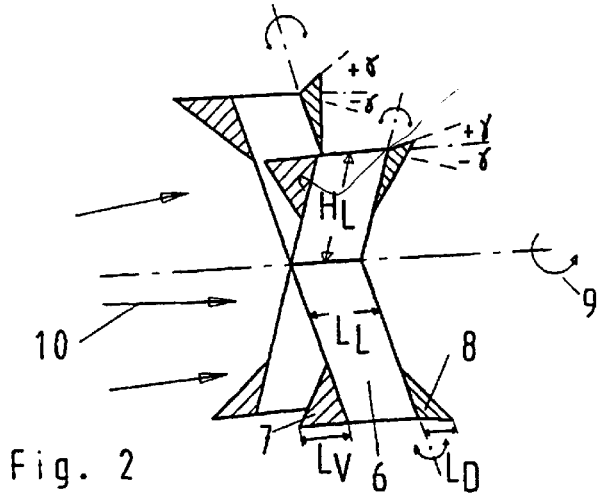
Fig. 2
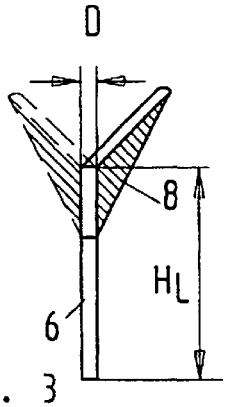
Fig. 3
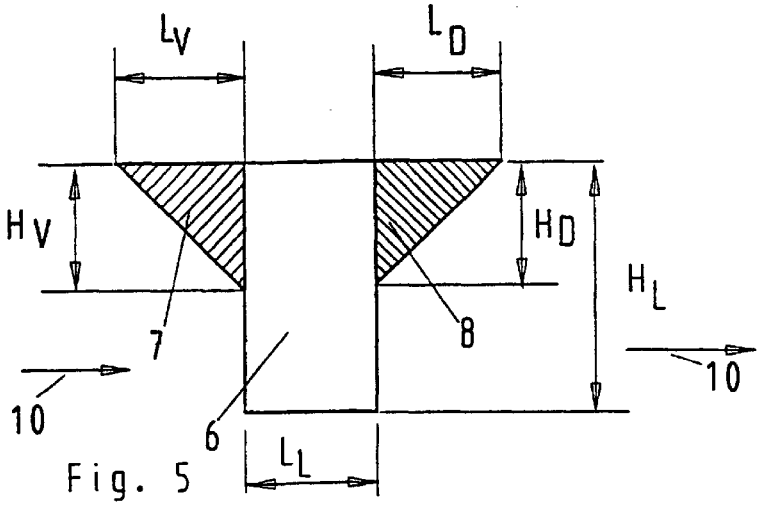
Fig. 5
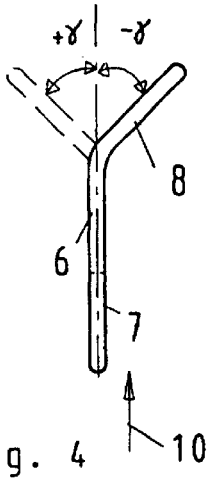
Fig. 4

CENTRIFUGAL PUMP WITH INFLOW GUIDE DEVICE

BACKGROUND OF THE INVENTION

The invention relates to a centrifugal pump with an axial inlet and an inflow guide device mounted upstream of the impeller, which guide device has several fixed guide vanes, which on the side facing the impeller each have an edge pointing towards or away from the direction of rotation of the impeller.

Centrifugal pumps with an axial inlet often have an inflow guide device mounted upstream of the first impeller. Their purpose is to remove a possible whirl from the transported fluid, such that an axial flow is present downstream of the inflow guide device.

The inflow guide device can be composed of several guide vanes, disposed uniformly around the perimeter of the inlet. The guide vanes can be attached to each other in the axis of the inlet and thus form a star or cross.

Inflow guide devices are known from DE 471 149 and DE 649 668 whose blades can be curved towards or away from the direction of rotation of the impeller in order to adapt to particular inflow conditions or to generate them. The curvature is bow shaped and extends in each case with the same axial length to the entire radial span of the blade. Here, when compared with the blade, the curvature has only a limited axial length.

In contrast to the previously described inflow guide device, which is equipped with seven blades and was relatively expensive, nowadays inflow crosses are preferred, that is, inflow guide devices comprising only four blades. These devices, inexpensive in themselves, are hardly able, however, to reduce an inherent disadvantage of the axial flow centrifugal pumps, the instability present in the pump's steady state characteristics. It is therefore the object of the invention to achieve such a reduction for a centrifugal pump of the type described above and on the whole to improve the flow conditions.

SUMMARY OF THE INVENTION

This object is achieved according to the invention in that the edge pointing in or opposite to the direction of rotation is formed by a swirl blade which is formed on the guide vane and located in the region of the inlet wall and which has a shorter radial length than the guide vane.

Experiments have shown that the efficiency of the flow machine is increased over a wide operating range by using the inventive design with a turbulence bade formed on the guide vane. This is especially true when the angle of incidence between the guide vane and the swirl blade is negative, that is, when the swirl blade points against the direction of rotation of the impeller.

In general, it can be said that the angle of incidence depends on the type of hydraulics. It can be determined based on measurements, that is, it can be determined with the purpose of achieving different effects on the pump's steady state characteristics at all operative conditions.

The effect of the swirl blade increases nearer to the wall. Therefore, it is advisable to increase the axial length of the swirl blade as it approaches the wall. Thus it is advantageous if, in designing the swirl blade, one starts with a right triangle whose hypotenuse is the edge facing the impeller.

The almost one-dimensional flow in the axial inlet is changed by means of the swirl blade into a three-dimensional whirling flow in the region of the wall of the inlet or of the inflow nozzle. This change leads to greater efficiency at all load conditions and reduces the instability of the pump. In particular, the kinetic energy of the gap flow and re-circulation flow is returned to the inflow so that energy is recovered. In cases of increased inlet flow, for example in the case of an overload, the pre-whirling increases.

In addition, because of the swirl blades, the beginning of the re-circulation upstream of the impeller shifts towards relatively low inlet flows. Thus, the hysteresis region on the pump's characteristic curve, dangerous to the operational performance of the pump, is displaced sharply to the left, something which substantially widens the range of the pump's use.

The change in the inflow which is achieved by the inflow guide device according to the invention leads to an adaptation of operative conditions which is more efficient and increases the breadth of applicability since the turbulence boundary is clearly displaced to the left. Due to the design in accordance with the invention, the flow onto the impeller is also improved, such that secondary currents and flow separations downstream from the impeller blades are minimized.

As a further development of the invention, it is suggested that one or more of the guide vanes each have on the edge opposite the impeller a pre-guide vane which is similar in shape and size to the swirl blade. It has been shown that this type of pre-guide vane further improves the flow guidance.

The invention can be realized by simple means if, as is known, the guide vanes are arranged in the form of a cross or a star.

The invention will be explained in further detail with reference to an illustrative working embodiment.

BRIEF DESCRIPTION OF THE DRAWINGS

FIG. 1 shows a partial section of a centrifugal pump according to the invention;

FIG. 2 shows an inflow guide device of the inventive type shown in perspective;

FIG. 3 shows a view of a guide vane with a swirl blade formed thereon, shown with two possible options for attachment;

FIG. 4 shows a top plan view of the guide vane of FIG. 3, and

FIG. 5 shows the side view of a guide vane with a swirl blade and a pre-guide vane formed thereon.

DETAILED DESCRIPTION OF PREFERRED EMBODIMENTS

The centrifugal pump shown in FIG. 1 has a housing 1 with an inflow nozzle 2 upstream from it. An impeller 4 is arranged on a shaft 3. A pressure pipe stub 5 forms the end in the direction of flow.

Upstream from the impeller 4, a turbulence cross, comprised essentially of four guide vanes 6, is fixed rigidly in the inflow nozzle 2. A pre-guide vane 7 and a turbulence vane 8 are mounted on each of the guide vanes 6. The rotation of the shaft 3 and the impeller 4 corresponds to the rotational direction indicator 9. Arrows 10, illustrated inside the housing 1 and at the exit of the pressure pipe stub 5, show the flow path of the transported medium.

It is important to note measurement S, which shows the distance between the center line of the guide vane 6 and the front edge of the impeller 4. The measurement S, which depends on the type of pump, especially on the impeller geometry, is to be determined, for example with the aid of experiments, such that the inflow guide device has an optimal influence on the flow and thus on the pump's characteristic curve.

With respect to the turbulence cross illustrated in FIG. 2, the relationship between guide vanes 6, the pre-guide vanes 7 and the swirl blades 8 can be seen. Here a possible angle range between $+\gamma$ and $-\gamma$ is indicated for the angle of incidence for the swirl blades 8. The positive angle $+\gamma$ points in the direction of rotation of the impeller 4. A negative angle $-\gamma$ lets the guide vane 6 point against the rotational direction of the impeller 4. When utilized in a controlled manner, both directions can influence the pump characteristics in a desired way.

The number of guide vanes 6 is determined by the geometry and the specific characteristics of the pump. It is within the knowledge and ability of an appropriate pump specialist to determine this.

In order better to identify the possible angle ranges for the adjustment of the swirl blade 8 on the guide vane 6, these are shown in even clearer detail in FIGS. 3 and 4. The blade thickness D can also be seen from these drawings.

Further measurements and their relationships to one another can be seen in FIG. 5. Accordingly, the guide vane 6 has a height $H_L$, the pre-guide vane 7 has a height $H_V$, the height of the swirl blade 8 is given as $H_D$. $L_L$ is the length of the guide vane 6. The length of the pre-guide vane 7 is given as $L_V$ and the length of the swirl blade 8 as $L_D$. The lengths and the heights of the guide vanes 6, the pre-guide vanes 7 and the swirl blades 8 are designed to have an optimal influence on the characteristic curve.

The pre-guide vane 7 and the guide vane 6, which both extend parallel to the axis of the inflow nozzle 2 and the impeller 4, exert a straightening influence on the inflow. The swirl blade 8 adjusted at an angle $\gamma$ alters the inflow direction relative to impeller 4. A desired swirl is brought about either with or opposite to the rotational direction of the impeller 4.

The swirl blade 8 develops its greatest influence in the region of the wall of the inflow nozzle 2. Should a re-circulation occur before the impeller, the intensity is reduced by means of the inflow guide device. All in all, the surface of the inflow guide device should be constructed as small and as hydraulically smooth as possible in order to minimize the frictional loss. In principle, the blades 6, 7, and 8 of the pre-guide device can also be contoured.

What is claimed is:

1. A centrifugal pump having an axial inlet leading to a rotatable impeller and an inflow guide device mounted upstream of the impeller, said inflow guide device comprising a plurality of fixed guide vanes each having an edge facing the impeller and pointing in or opposite to the direction of rotation of the impeller, wherein said edge comprises a swirl blade formed on the guide vane and located adjacent a wall of the inlet, said swirl blade having a shorter radial length than said guide vane.

2. A centrifugal pump according to claim 1, wherein the swirl blade has the form of a right triangle with a hypotenuse forming an edge facing the impeller.

3. A centrifugal pump according to claim 1, wherein at least one of the guide vanes has on its side facing away from the impeller, a pre-guide vane similar in shape and size to the swirl blade.

4. A centrifugal pump according to claim 1, wherein the guide vanes are arranged in the form of a cross.

5. A centrifugal pump according to claim 1, wherein the guide vanes are arranged in the form of a star.

* * * * *